United States Patent [19]

Wincent

[11] Patent Number: 4,494,887

[45] Date of Patent: Jan. 22, 1985

[54] HIGH SPEED PRINTER ASSEMBLY

[75] Inventor: Karl T. Wincent, Tiverton, R.I.

[73] Assignee: Litton Systems, Inc., Fall River, Mass.

[21] Appl. No.: 569,578

[22] Filed: Jan. 10, 1984

[51] Int. Cl.[3] ..... B41J 19/80; B41J 33/18

[52] U.S. Cl. ..... 400/568; 400/573; 400/236.1

[58] Field of Search ..... 400/236.1, 305, 320, 400/328, 637.6, 649, 572, 692, 694, 573, 660.2, 545, 568, 570, 648

[56] References Cited

U.S. PATENT DOCUMENTS

| | | | |
|---|---|---|---|
| 2,233,092 | 2/1941 | Bernhard | 400/328 |
| 3,504,780 | 4/1970 | Rekewitz | 400/570 |
| 3,651,916 | 3/1972 | Becchi | 400/328 X |
| 4,150,903 | 4/1979 | Bailey et al. | 400/694 X |
| 4,221,489 | 9/1980 | Engle et al. | 400/637.6 X |
| 4,381,155 | 4/1983 | Kondur, Jr. | 400/236.1 X |
| 4,383,772 | 5/1983 | Meier et al. | 400/649 X |

FOREIGN PATENT DOCUMENTS 2710524 8/1978 Fed. Rep. of Germany ..... 400/328

*Primary Examiner*—Edgar S. Burr
*Assistant Examiner*—James R. McDaniel
*Attorney, Agent, or Firm*—Brian L. Ribando

[57] ABSTRACT

A high speed printer comprises a molded base having a plurality of plastic towers integrally molded thereon. A cylindrical platen is mounted on a first pair of plastic towers and a drive shaft having a helical groove along the length thereof and an eccentric drive pin at one end is mounted on a second pair of plastic towers. A slide bar mounted for reciprocating motion and having a drive slot for receiving the eccentric drive pin supports a paper feed pawl and a ribbon feed pawl. A single motor drives the drive shaft, whereby the helical groove drives a print head across the platen and the eccentric drive pin reciprocates said slide bar to drive the paper feed pawl and the ribbon feed pawl.

12 Claims, 10 Drawing Figures

HIGH SPEED PRINTER ASSEMBLY

This invention relates to a high speed printer having a simplified construction which is powered by a single motor.

BACKGROUND OF THE INVENTION

High speed printers used as output devices for computers and word processors are well known in the art. Such printers are complex mechanisms owing to the printing, paper feed, and ribbon feed functions which they must perform. Such functions are usually carried out by separate motor assemblies, and the requirement of a plurality of motors, in addition to the other mechanisms necessary in a printer, results in a device which is complex, requires a great deal of assembly time, and is prone to malfunction.

OBJECTS OF THE INVENTION

It is therefore an object of the invention to provide a high speed printer which is powered by a single motor.

It is another object of the invention to provide a high speed printer in which all subassemblies are mounted on towers integrally formed with the printer base to simplify assembly procedures.

These and other objects of the invention will be apparent from the following specification taken in conjunction with the accompanying drawing figures.

DESCRIPTION OF THE PREFERRED EMBODIMENT

Figure 1:
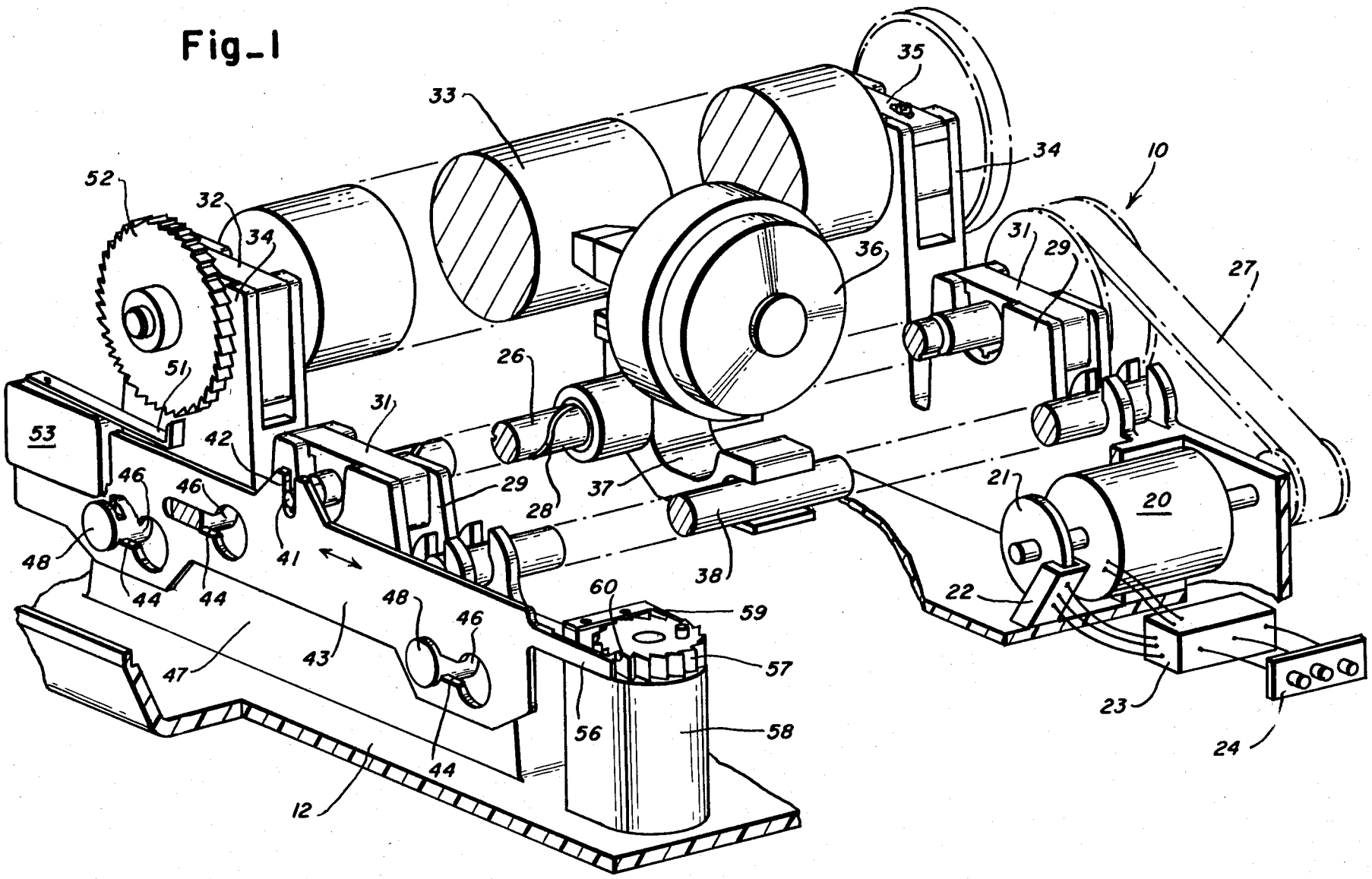
FIG. 1 is a perspective view of the left side of a high speed printer assembly according to the invention.
Figure 2A:
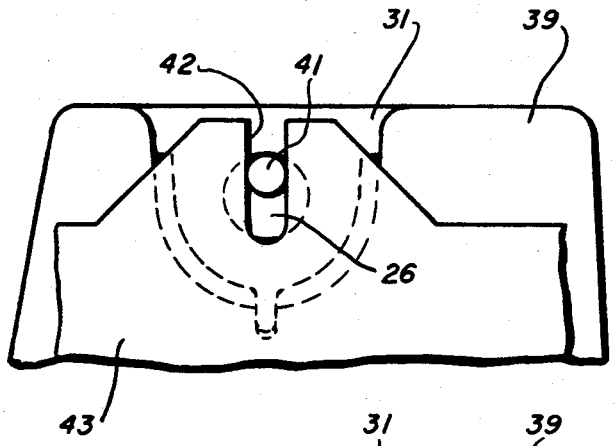
FIGS. 2A–2D are side views showing four positions of the drive shaft and slide bar of the invention.
Figure 2B:
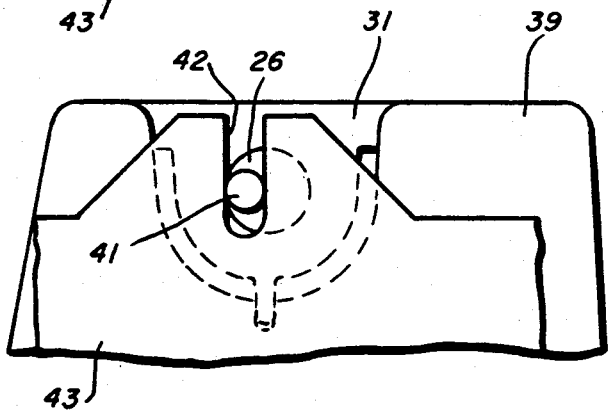
Figure 2C:
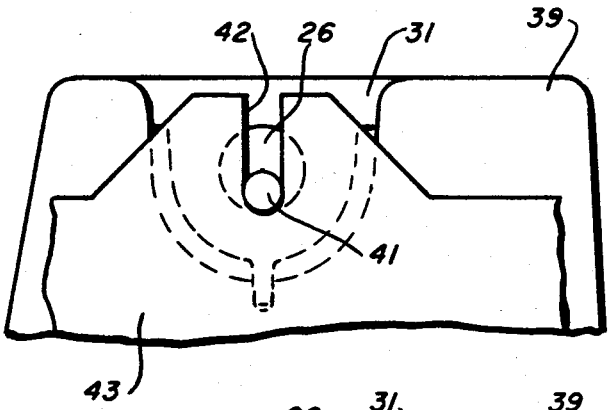
Figure 2D:
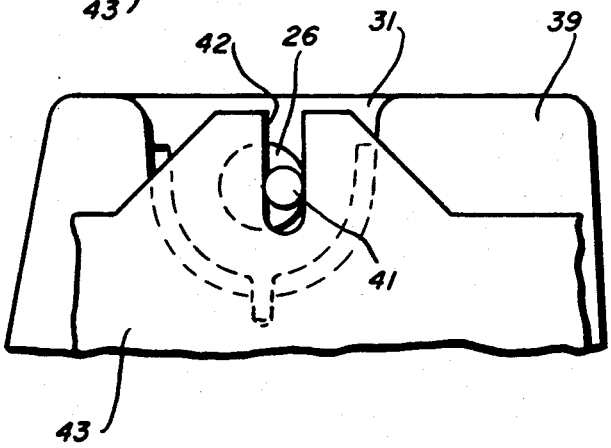

Referring to FIG. 1, there is shown a high speed printer assembly generally designated by the reference numeral 10. The assembly 10 is mounted on a base 12 which is molded of plastic and which has formed thereon a plurality of plastic towers 13 onto which all of the subassemblies of the printer can be mounted. The printer is designed so that the various subassemblies necessary for the operation of the printer may be fastened directly to the plastic towers by a snap fit mechanism or by a threaded fastener as will be described more fully hereinbelow. This construction technique requires minimum mounting hardware and may be performed in a relatively short amount of time.

Figure 4A:
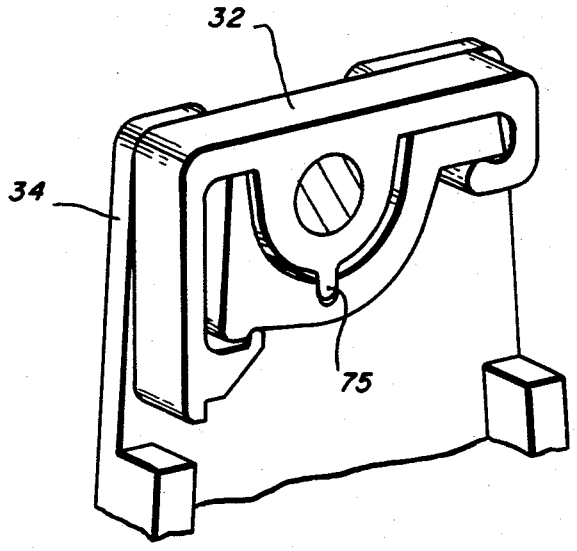
FIGS. 4A and 4B show the bearing assemblies used in the printer.

A low cost D.C. motor 20 provides power for the printer 10 and is coupled to a printer drive shaft 26 by means of a belt 27. The drive shaft 26 includes a helical drive grove 28 which is cut along the length of the shaft. The shaft is mounted on drive shaft towers 29 by means of plastic bearings 31 which snap fit into recesses formed on the towers. A similar bearing 32 is shown in FIG. 4A and is used to mount one end of the platen 33 to the platen tower 34.

A print head 36 is attached to a carriage 37 which is mounted on the drive shaft 26. A guide bar 38 is used to steady the carriage 37 as the print head 36 is driven back and forth across the platen 33, and to prevent rotation of the carriage and print head combination in response to rotation of the drive shaft 26.

One end of the drive shaft 26 includes an eccentric drive pin 41. The drive pin 41 is received in a drive slot 42 of a slide bar 43. Rotation of the drive shaft 26 causes the eccentric pin 41 to orbit around the axis of the drive shaft 26, and this orbiting motion is translated by the slide bar 43 into a back and forth reciprocating motion best seen in FIGS. 2A–2D. The slide bar is mounted by means of three slots 44 onto posts 46 which are formed on the slide bar towers 47. The posts have enlarged ends 48 which prevent the slide bar 43 from being removed from the posts 46 once the slide bar has been postioned thereon.

A paper feed pawl 51 is mounted on the end of the slide bar 43 nearest a platen drive gear 52. A solenoid 53 mounted beneath the paper feed pawl 51 is operative to hold the pawl 51 out of engagement with the platen drive gear 52 unless de-energized.

The opposite end of the slide bar 43 includes a ribbon feed pawl 56 which engages a ribbon drive gear 57 mounted on a ribbon drive tower 58. The ribbon drive gear 57 drives the take up spool of an inked ribbon cartridge (not shown) used with the printer 10. A no back pawl 59 is mounted on the side of the drive gear 57 opposite the ribbon feed pawl 56 to restrict rotation of the ribbon drive gear 57 to the clockwise direction.

Figure 3:
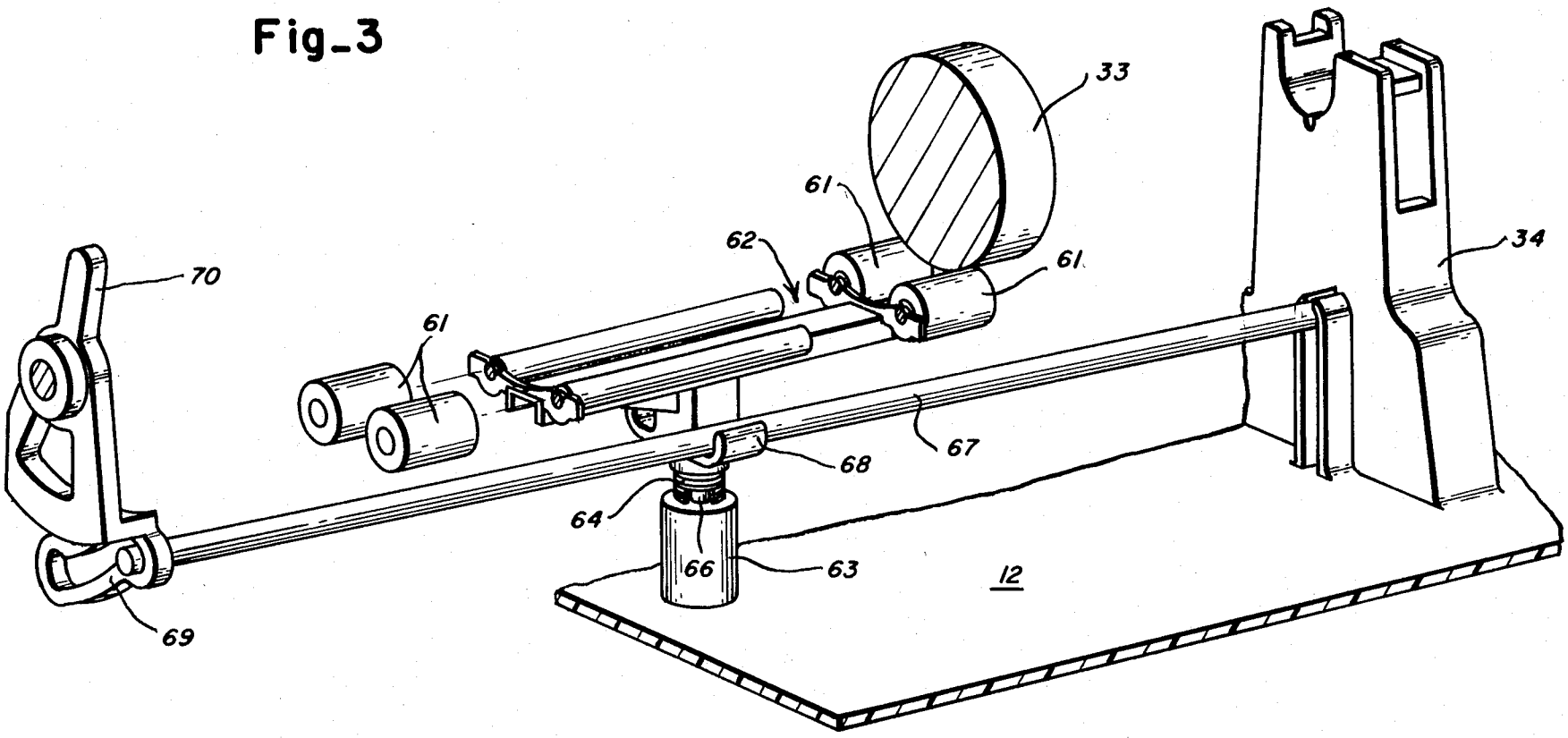
FIG. 3 is a perspective view of the pressure roller assembly used in the high speed printer.

Turning now to FIG. 3, it will be seen that four pressure rollers 61 are mounted on a common rack 62 and are positioned to engage the underside of the platen 33 through the paper (not shown) which is being printed. The rack 62 is mounted to the machine base 12 by a stem 66 which is received by a pressure roller tower 63. A spring 64 is used to continually urge the rack of four rollers into contact with the platen 33. It will be appreciated that since the rack 62 and the stem 66 are rotatable in the pressure roller tower 63, the rack maintains its alignment with the platen 33 automatically. This alignment assures that the feed of paper through the printer will be even and smooth.

In order to disengage the pressure rollers 61 from the underside of the platen 33, a rod 67 is pivotally mounted in one of the platen towers 34, passes through a yoke 68 located on the underside of the pressure roller rack 62, and is received by a movable cam 69 mounted on the other of the platen towers. A lever 70 on the cam 69 is movable to lower the rod 67 causing the pressure roller rack 62 to be lowered against the spring 64 and toward the base 12 to draw the pressure rollers 61 out of contact with the platen.

Figure 4B:
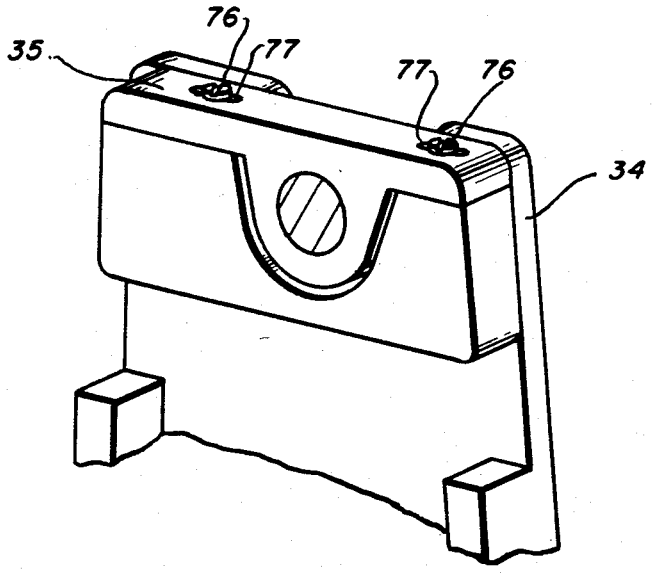

In order to achieve satisfactory printing, it is imperative that the distance between the print head and the platen remain constant as the print head traverses the length of the platen. Referring to FIG. 4A, it will be see that the dimple 75 on the left-hand platen bearing 32 allows the bearing be snapped into the left-hand platen tower 34 in only a single position. The right-hand platen bearing 35 shown in FIG. 4B is, however, mounted in the tower 34 by means of screws 76 which pass through the slots 77 in the bearing and allow the bearing to be slid back and forth. After the platen and the print head have been mounted on the base, the distance between the print head and the platen is measured with the print head at the left side of the drive shaft. After this distance is determined, the print head is moved to the right end of the drive shaft, and the platen is moved by allowing the right-hand platen bearing 35 to slide back or forth as required in the right-hand platen tower. Once the distance measured between the print head and the platen is the same on the right end of the platen as on the left, the platen bearing 35 is secured in place by means of the screws 76. Using this single adjustment, the path of travel of the print head 36 will be parallel to the platen 33.

MODE OF OPERATION OF THE PREFERRED EMBODIMENT

All moving functions of the printer assembly are powered by a single D.C. motor 20. The rotation of the motor is monitored by an optical encoder disc 21 and a read head 22 which is coupled to a microprocessor controller 23. The controller 23 is preprogrammed with certain printer operation commands, and receives additional commands from a control panel 24.

Figure 6:
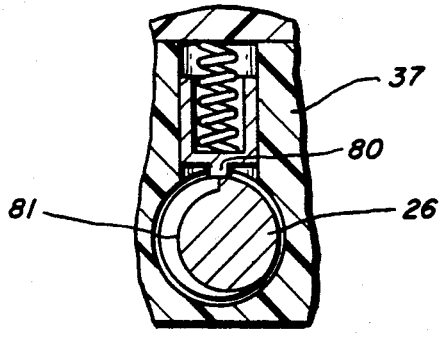
FIG. 6 is a side view of the drive shaft and guide pin of FIG. 5.
Figure 5:
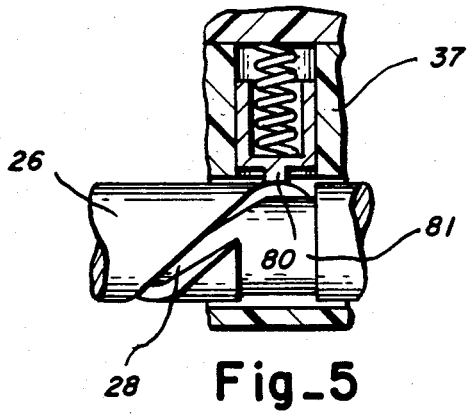
FIG. 5 is a front view of the drive shaft end and guide pin of the printer.

The rotation of the drive shaft 26 causes the print head 36 and carriage 37 to travel back and forth across the platen 33. As best seen in FIG. 5, a spring loaded pin 80 mounted in the carriage 37 follows the helical grove 28 formed on the drive shaft. At either end of the drive shaft 26, the helical grove 28 is intercepted by a circumferential ramp 81 as shown in FIG. 6. When the pin 80 enters the circumferential ramp 81, the drive shaft is able to continuously rotate while the print head remains stationary at the end of the platen. This feature allows the drive shaft to rotate in order to accomplish certain machine functions, such as paper feed, without changing the position of the print head.

As described above with reference to FIGS. 2A–2D, the back and forth motion of the slide bar 43 causes a paper feed pawl 51 to pass back and forth underneath the platen drive gear 52. The paper feed pawl 51 is normally held out of engagement with the platen drive gear 52 by means of a solenoid 53 under control of the printer logic module 23. The printing of a single line of print from one end of the platen 33 to the other requires about 8.8 revolutions of the drive shaft 26. During this time, as long as the solenoid 53 is energized, the platen drive gear 52 is unaffected by the back and forth motion of the paper feed pawl 51. Once the print head has reached the end of the line, however, paper must be advanced in order to print the next line of characters. In order to advance the printer, the solenoid is de-energized causing the paper feed pawl 51 to spring into a position whereby it will contact the platen drive gear 52. A single revolution of the drive shaft 26 will shift the slide bar 43 causing the paper feed pawl to rotate the drive gear 52 to advance the paper to a new print line. The solenoid 53 may be controlled by the logic module 23 which receives a signal from a limit switch (not shown) which is tripped when the pin 80 is raised by the circumferential ramp 81. After the paper has been advanced, the logic module 23 will cause the motor 20 to reverse its direction of rotation, causing the print head to traverse the platen in the opposite direction.

While the printer is in operation, the inked ribbon must be periodically advanced to present a new area of ribbon to the print head. The ribbon feed pawl 56 located on the slide bar 43 is positioned to engage and rotate the ribbon drive gear 57 which is coupled to the take-up reel of the ribbon cartridge (not shown). The ramp portion 60 of the ribbon feed pawl 56 allows it to ratchet past the drive wheel 57 which is held against reverse rotation by the no back pawl 59 when the slide bar is moving in the direction toward the ribbon drive gear 57. On the return stroke when the slide bar 43 is moving away from the gear 57, the edge of the pawl catches and rotates the drive gear 57 one increment of revolution.

Having thus described the invention, various alterations and modifications will occur to those skilled in the art, which modifications and alterations are intended to be within the scope of the invention as defined by the appended claims.

What is claimed is:

1. A high speed printer including a movable print head used for printing lines of information on a record carrier, said high speed printer comprising:

a molded base having a plurality of plastic towers integrally molded thereon, a cylindrical platen mounted on two of said plastic towers for supporting said record carrier, a platen drive gear mounted on one end of said platen, a drive shaft having a helical groove along the length thereof and an eccentric drive pin at one end, a pair of plastic towers supporting said drive shaft, a movable carriage supporting said print head and having means for following said helical groove, a slide bar mounted for reciprocating motion and having a drive slot for receiving said eccentric drive pin, platen drive means on said slide bar for selective engagement with said platen drive gear, and a single motor for driving said drive shaft, whereby said helical groove drives said print head across said platen and said eccentric drive pin reciprocates said slide bar to rotate said platen through said platen drive means.

2. The high speed printer of claim 1 further comprising:

a ribbon drive gear mounted on a ribbon drive tower for advancing an inked ribbon, and a ribbon feed pawl on said slide bar, whereby the reciprocating motion of said slide bar incrementally rotates said ribbon drive gear through said ribbon feed pawl.

3. The high speed printer of claim 1 further comprising:

pressure roller means for biasing said record carrier against said platen, a spring loaded rack for supporting said pressure roller means, a stem for pivotally mounting said spring loaded rack, and a pressure roller tower molded into said base for receiving said stem.

4. The high speed printer of claim 3 further comprising:

a ribbon drive gear mounted on a ribbon drive tower for advancing an inked ribbon, and a ribbon feed pawl on said slide bar, whereby the reciprocating motion of said slide bar incrementally rotates said ribbon drive gear through said ribbon feed pawl.

5. The high speed printer of claim 1 further comprising:

a spring loaded pin comprising said means for following said hellical groove, a circumferential ramp formed at each end of said drive shaft in communication with said helical groove, and said circumferential ramp allowing said drive shaft to rotate without displacing said print head and carriage in order to effect a paper feed operation.

6. The high speed printer of claim 5 further comprising:

a ribbon drive gear mounted on a ribbon drive tower for advancing an inked ribbon, and a ribbon feed pawl on said slide bar, whereby the reciprocating motion of said slide bar incrementally rotates said ribbon drive gear through said ribbon feed pawl.

7. The high speed printer of claim 1 further comprising:

a paper feed pawl comprising said platen drive means, and a solenoid for holding said paper feed pawl out of engagement with said platen drive gear.

8. The high speed printer of claim 7 further comprising:

a circumferential ramp formed at each end of said drive shaft in communication with said helical groove, and said circumferential ramp allowing said drive shaft to rotate without displacing said print head and carriage in order to effect a paper feed operation.

9. The high speed printer of claim 1 further comprising:

pressure roller means for biasing said record carrier against said platen, a spring loaded rack for supporting said pressure roller means, a stem for pivotally mounting said spring loaded rack, and a pressure roller tower molded into said base for receiving said stem.

10. The high speed printer of claim 9 further comprising:

a yoke mounted on said spring loaded rack, a rod in engagement with said yoke and pivoted at one end to said platen tower, and a cam means for controlling the vertical position of the other end of said rod, whereby the position of said rack may be adjusted to withdraw said pressure rollers away from said platen.

11. The high speed printer of claim 1 further comprising:

a D.C. motor comprising said single motor, and encoder means for sensing the rotation of said D.C. motor.

12. The high speed printer of claim 1 further comprising:

a pair of bearings for mounting said platen on said platen towers, one of said bearings being fixed in position relative to said drive shaft, and the other of said bearings being adjustable in position relative to said drive shaft, whereby one end of said platen may be positioned so that said platen is parallel to said drive shaft and the path of travel of said print head.

* * * * *